United States Patent [19]

Guschin et al.

[11] 4,003,105

[45] Jan. 18, 1977

[54] APPARATUS FOR TRANSFORMING AN AIR-FIBRE DISPERSION STREAM IN THE MANUFACTURE OF HOMOGENEOUS FIBROUS MATERIALS

[76] Inventors: Alexandr Evgenievich Guschin, Kovensky pereulok, 13, kv. 18; Alexandr Andreevich Khokhryakov, Institutsky prospekt, 9, kv. 62; Evgeny Yakovlevich Pechko, Krasnoe selo, Fabrichny poselok, 4, kv. 7; Konstantin Ivanovich Obraztsov, prospekt Parkhomenko, 6, kv. 68; Anatoly Vasilievich Konstantinov, Svetlanovsky prospekt, 21, kv. 46; Vyacheslav Sergeevich Alexandrov, ulitsa Nezhinskaya, 4, kv. 123, all of Leningrad, U.S.S.R.

[22] Filed: Sept. 15, 1975

[21] Appl. No.: 613,511

[52] U.S. Cl. ..... 19/155

[51] Int. Cl.[2] ..... D01G 25/00

[58] Field of Search ..... 19/155, 156–156.4, 19/205, 148; 156/62.2, 62.4, 62.6; 425/80, 81, 82, 83

[56] References Cited

UNITED STATES PATENTS

| | | | |
|---|---|---|---|
| 2,450,511 | 10/1948 | Harner et al. | 19/156.3 |
| 2,743,758 | 5/1956 | Uschmann | 19/155 |
| 2,840,865 | 7/1958 | Reed | 19/155 |
| 2,919,475 | 1/1960 | Heppenstall et al. | 19/155 |

*Primary Examiner*—Dorsey Newton
*Attorney, Agent, or Firm*—Robert E. Burns; Emmanuel J. Lobato; Bruce L. Adams

[57] ABSTRACT

In the apparatus of the invention a slot nozzle is arranged on an outlet of a pipe for supplying an air-fibre dispersion stream into a chamber with said nozzle disposed therein so that the slot of the nozzle is perpendicular to chamber side walls. A body with a curvilinear cambered plane is disposed in the chamber and is essentially a cylinder with a generatrix length of no less than the nozzle slot length. Said cylinder has a diameter no less than 1.2 times the nozzle slot width and is spaced under said nozzle at 0.3 to 1.0 cylinder diameter. In addition, a spacial lattice, spanning over a chamber cross-section for smoothing the air-fibre stream, is placed under the cylinder 2 to 6 diameters of the latter down stream from the nozzle and the cylinder.

1 Claim, 1 Drawing Figure

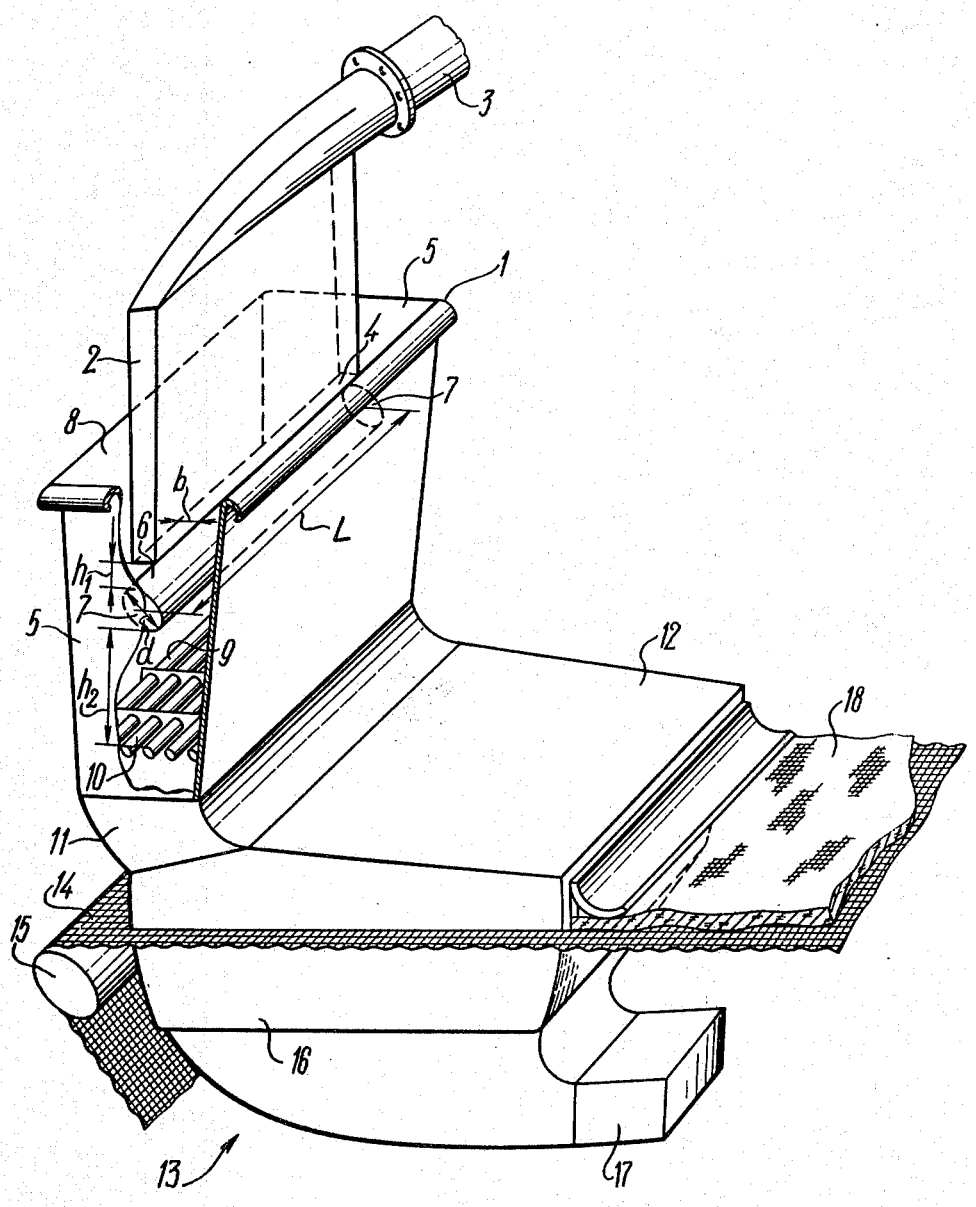
3
5
1
2
4
7
8
b
6
L
h1
7
5
d
9
12
h2
18
10
11
14
15
16
13
17

APPARATUS FOR TRANSFORMING AN AIR-FIBRE DISPERSION STREAM IN THE MANUFACTURE OF HOMOGENEOUS FIBROUS MATERIALS

BACKGROUND OF THE INVENTION

The present invention relates to apparatus for transforming an air-fibre dispersion stream and is applicable in pulp-and-paper, textile and building industries for production of various grades of paper, nonwoven fabrics, felts and other fibrous materials homogeneous in structure.

The transforming of the air-fibre stream discussed herein is assumed to be such a change which results in increasing of a stream cross-sectional area and consequent reduction of an average stream velocity, a uniform distribution of a velocity field of the stream in its cross-section, a generation of a fine-scale turbulence in the air-fibre mixture, a homogeneous fibre distribution throughout the stream and an increasing of a dispersity value of the air-fibre suspension while the stream is being transformed.

The distribution of the velocity field of the air-fibre stream, as applied to the apparatus of the invention, is assumed to be uniform in the stream cross-section if the coefficient of variation of random local velocities is not over 17 percent.

The dispersity value of the air-fibre stream is assumed to be a ratio of a volume of discrete fibers or small fibrous aggregates to a volume of an individual fibre of mode-length, i.e. the length which predominates in the fibre length distribution.

Let the dispersity value of the air-fibre mixture be no more than 60. The volume of the individual mode-length fibre is obtainable from the direct measurement of the fibre sizes. The fibrous aggregate volume may be estimated by the use of high speed filming.

The homogeneous fibre distribution in the air stream assumes the fibre concentration in each individual stream volume to have little or no fluctuations.

The degree of uniformity of the concentration distribution of the fibres in the air stream can be indirectly determined by an optical method, using a light beam measuring 0.5×0.5 mm in its cross-section.

Fluctuations of the fibre concentration in the air stream change an intensity of the light passing through the stream and striking a photocell. The light intensity fluctuations result in changing of a photoelectric current developed in the cell. The recording means enables anyone to calculate the coefficient of variation of the light intensity fluctuations, thus variations of the fibre concentration in the stream are indirectly represented.

With the distribution of the fibre concentration uniform, the coefficient of variation, determined by the aforementioned method, is in the range from 18 to 25 percent.

The transforming of the air-fibre mixture is quite important, because it enables fibrous material having homogeneous structure, predominantly paper, i.e. a material with uniform physic-chemical properties, to be produced in a forming aerodynamic unit.

For example, when filter paper is being produced, the transforming of the air-fibre stream provides the uniformity of such properties as porosity, tensile strength, shearing strength, coefficient of extensibility etc., i.e.

the transforming of the stream effects the quality of the finished materials.

In combination with the forming aerodynamic unit of the known design the apparatus of the invention may be used in various machines and means where fibrous material homogeneous in structure is produced.

In order to make a web of the fibrous homogeneous material various kinds of fibre are used: native, including chemical wood, chemical, non-organic, and preferably fibres of 0.5 to 15 mm long. For example, when various grades of paper or nonwoven fabrics are being produced, mechanical wood, sulphate and sulphite cellulose, lint cotton, flax, asbestos and other kinds of fibre are used.

The kind of fibre generally used depends on properties of the material to be produced therefrom. So, asbestos fibre provides the material with high thermal and electrical insulation properties, polypropylene fibre permits the material being produced to be alcali resistant, while cotton and dacron provide biological safety for the finished product.

The fibrous materials with various properties, e.g. the aforementioned, are applicable in aircraft, electrotechnical, metallurgy and other industries, and are of great importance, enabling many technical problems to be carried out.

The transforming of the air-fibre dispersion stream, enhance production of fibrous material homogeneous in structure, is known to have the following requirements:

The uniform distribution of the velocity field in the cross-section of the air-fibre steam is to be achieved; this is necessary to produce the fibrous material homogeneous in structure edgewise by the aerodynamic forming unit. The velocity field being elongated, for example, along its longitudinal axis, results in the manufacture of the material having a "hill-shaped" fibre distribution edgewise and having a strongly marked maximum in its middle. The fibre distribution throughout a thickness of the material should be similar to the abovementioned.

The velocity of the air-fibre mixture is to be reduced in order to provide for the production of the fibrous material while supplying the transformed air-fibre stream parallel to a wire screen of the forming unit. The stream velocity equal to a rate of the travelling wire prevents the latter from disturbing the transformed stream, consequently resulting in a non-homogeneity of the material in structure.

The fine-scale turbulence of the flow to be generated that, as well known to those skilled in the disperse system arts, does not result in a local fibre flocculation, the latter having a negative effect on the homogeneity of the fibrous material.

The dispersity value of fibrous solids in the air-fibre mixture is to be increased by providing a homogeneous distribution over an entire stream volume, i.e. a homogeneous fibre dispersion in the air stream is to take place. This is an important condition of the production of a fibrous material homogeneous is structure.

Apparatus for the distributing of the air-fibre mixture are known, these apparatus comprising means for expanding the stream before it is supplied onto the wire of the forming unit. From a disperser chamber the air-fibre stream through a discharging pipe generally enters a diffuser, having diverging side walls and converging frontal walls. In the diffuser the stream is expanded edgewise, without reducing the velocity, thus not resulting in an elongating of the stream velocity field; this elongating is usually peculiar to diffusers. Owing to such a design, the uniform distribution of velocities of the transformed air-fibre stream is achieved.

However, the apparatus described does not provide the required homogeneous distribution of the fibres with high dispersity value and hence it is not applicable for the production of homogeneous material, when the fibre dispersity value is high.

Another type of stream transforming apparatus represents a diffuser, having diverging side and frontal walls and rotating rollers, arranged therein, the latter comprising teeth.

The air-fibre stream supplied to the diffuser is subjected to a treatment of said rollers, thus resulting in the uniform distribution of the flow velocity field. The velocity smoothing is attended with mechanical agitating of the air bulk and separating of large aggregates into small fibrous solids.

This type of apparatus also does not provide all parameters to fulfill the conditions which are necessary for producing fibrous homogeneous material, because the fine-scale turbulence of the stream and the homogeneous distribution of fibres in the air are not achieved.

One more apparatus for stream transforming represents a diffuser with a faired-form body disposed therein.

The air-fibre stream, supplied to the apparatus through an inlet pipe, interacts with said body and uniformly distributes all over the diffuser cross-section thus smoothing the velocity field of the stream. The latter is expanded vertically and edgewise horizontally and as a result the flow velocity is reduced.

In apparatus of such type the desired transforming of the air-fibre stream also does not take place.

Yet another modified apparatus for the transforming of the air-fibre stream is known. It comprises a diffuser with diverging side walls and an inlet opening communicating with the stream supplying pipe-line. An outlet opening of the diffuser is connected with a rectangular upright chamber. Several faired airfoil-form bodies are arranged in the chamber with their planes parallel to the chamber side walls, the upper portion of each body disposed inside the diffuser. The air-fibre suspension supplied to the diffuser is impacted against the faired-form bodies and distributed edgewise over the rectangular chamber. The flow velocity is reduced, and the uniform distribution of the velocity field is attained.

This apparatus cannot provide the fine-scale turbulence of the stream, because of its interaction with the faired airfoil form bodies. This interaction generates a large-scale turbulence, thus hindering the homogeneous fibre distribution required to be achieved.

No one of the known stream transforming apparatus can provide the desired degree of transforming of the stream of high fibre concentration, especially, when the air-fibre flow is assumed to be fluidized, i.e. when the volume concentration of fibres is equal to 0.3.

SUMMARY OF THE INVENTION

It is a primary object of this invention to provide an apparatus for such transforming of an air-fibre stream as to meet all requirements which enable the production of a material homogeneous in structure, predominantly paper, when a high fibre concentration occurs.

Another object of the invention is to provide a stream transforming apparatus for producing a homogeneous material, predominantly paper, which apparatus is characterized by an increased production output, a reduced expenditure of current, and decreased sizes and metal consumption needed for the forming unit made therefrom.

This object is attained by providing an apparatus for producing fibrous homogeneous material, comprising a chamber connected with a forming unit, said chamber having disposed therein a body with a curvilinear chambered plane for dispersing an air-fibre stream throughout a chamber volume and facing a pipe which supplies the air-fibre mixture to the interior of said chamber. The apparatus according to the invention further includes a slot nozzle, arranged in the chamber on an outlet of the supplying pipe with the slot perpendicular to chamber side walls, a body for dispersing the air-fibre stream, comprising a cylinder with a generatrix length of no less than a nozzle slot length and a diameter of no less than 1.2 width of the nozzle slot, and wherein said cylinder is spaced 0.3 to 1.0 cylinder diameter apart the nozzle slot. A special lattice for dispersing the air-fibre stream and smoothing the latter spaced downstream from the cylinder two to six times the cylinder diameters and spans the chamber cross-section.

The main feature of the invention is as follows.

Due to the stream transforming apparatus including a nozzle, the velocity of the mixture can be increased and the stream may be distributed in a flatten-form over the entire length of the dispersing cylinder. The nozzle is completely within the chamber of the transforming apparatus.

Due to the cylinder being disposed under the nozzle, the air-fibre stream, being flatten out, impacts against the cylinder surface. The distance between the slot of the elongated nozzle and the cylinder is chosen within a range 0.3 to 1.0 the cylinder diameter so that a back pressure, generated by the cylinder surface, enhances the smoothing of the velocity field profile. The interaction of the flatten-form stream with the cylinder causes multiple fibre dispersion, resulting from the resilient repelling of fibrous solids against the cylinder surface. Thus fibre solid shredding, i.e. increasing of the dispersion value, takes place.

The multiple dispersion effect provides the homogeneous distribution of the fibrous particles, when the stream with high concentration, e.g. the volume concentration equal to 0.3 is used. Forces caused by this process are sufficient to agitate the air-fibre mixture with high contents of fibrous solids per stream volume unit.

The diameter of the cylinder is no less than 1.2 times the width of the nozzle slot, said cylinder being chosen to have such a surface curvature as to provide the fibrous solids to be dispersed inside the chamber to both sides from the cylinder. The curvature of the cylinder also permits the solids to be repelled from the surface and not to accumulate thereon, while smoothly flowing over the cylinder.

The cylinder, scheduled in the apparatus, provides transversal pulsations in the air-fibre stream flowing past the cylinder. These pulsations distribute the stream throughout the chamber volume and reduce the stream velocity. The special lattice arranged under the cylinder at a distance of two to six diameters of the latter, is spanning the entire chamber cross-section, smoothing the velocity field profile of the stream across the chamber cross-section and preventing the large-scale turbulence from being generated. The stream with the fine-scale turbulence is consequently attained.

Members of the spacial lattice may comprise cylindrical or elliptical rods, edge-rounded plates, etc.

The distance $h_2$ between the cylinder and the special lattice two to six cylinder diameters, is chosen in order to enable the air-fibre to be distributed over the entire chamber cross-sectional area before the stream interacts with the special lattice.

Thus, the apparatus of the invention enables the transforming of the stream in accordance with all requirements, providing for the manufacture of the fibrous material homogeneous in structure, predominantly paper. The slot nozzle combined with the cylinder in the present apparatus provides the intensive dispersion of fibre solids in the air stream, when the concentration of fibres is quite high, i.e. volume concentration equal to 0.3.

Owing to such a design, the production output of the fibrous homogeneous material is increased, the expenditure of current reduced because less amount of the air per time unit must be removed with a sufficient resistance coefficient through the wire forming surface, than in the case of low concentration. As a result, the sizes of the operating wire surface, through which the air is removed, may be decreased, thus reducing the unit sizes and the quantity of metal needed for forming a unit made therefrom.

Other objects and advantages of the present invention will become more apparent from the attached drawing which illustrates a perspective view of an apparatus according to the invention for transforming an air-fibre stream in the manufacture of fibrous materials. The apparatus is illustrated positioned on a plane-form wire aerodynamic forming unit.

DESCRIPTION OF THE PREFERRED EMBODIMENT

The apparatus shown in the drawing, comprises a chamber 1 with inclined frontal walls which are normal to the pair of parallel side walls 5, a slot nozzle 2, secured to a pipe 3, and disposed within the chamber 1, said pipe supplying the air-fibre mixture. The slot 4 of the nozzle 2 is disposed perpendicular to side walls 5 of the chamber 1.

A body, dispersing the air-fibre stream and representing a cylinder 6, is arranged under the nozzle 2.

A length L of a cylinder generatrix is equal to 1.3 times the length of the nozzle slot 4. A diameter $d$ the cylinder is equal to 1.5 times the width $b$ of the nozzle slot 4, and the cylinder 6 is located at a distance $h_1$ from the nozzle slot 4 equal to 0.6 times the diameter of the cylinder 6.

The cylinder 6 fixed with its ends 7 to side walls 5 of the chamber 1 is equally spaced between each frontal wall 8. A special lattice 9, circumferentially secured to the side walls 5 and 8 of the chamber 1 over the entire cross-sectional area of the latter, is placed under the cylinder at a distance $h_2$, wherein $h_2$ is equal to three diameters $d$ of the cylinder.

The lattice 9 consists of a plurality of cylindrical rods 10.

The chamber 1 communicates by an intermediate unit 11 with a fibre distributing chamber 12 of an aerodynamic forming unit 13.

Under the chamber 12 is disposed an endless plane-form wire 14, travelling over a shaft 15.

A suction box 16 connected by a branch pipe 17 with an intake fan (not shown) is arranged under the wire 14.

The apparatus for the transforming of the air-fibre dispersion stream in the manufacture of paper operates in the following way.

The chemical wood dispersed in the air stream, with the volume concentration of fibres equal to 0.3, through the pipe 3 enters the slot nozzle 4, wherein expanding of the stream edgewise and increasing of the flow velocity to 1.5 times as large as that in the pipe 3, take place.

The cylinder 7 generates addition pressure resistance to the flatten-form stream discharging from the slot 4 of the nozzle 2, thus causing redistribution of the velocity field of the stream inside the nozzle, resulting in uniformity of the velocity field.

The flatten-form stream, discharged from the slot 4 of the nozzle 2, interacts with the cylinder 7. The multiple repelling of fibre solids against the cylinder surface enhances the fibre dispersion. After impacting against the cylinder surface, the fibre sizes are reduced, i.e. the value of fibre dispersity is increased. Simultaneously, fibrous solids are homogeneously distributed throughout the air-stream volume.

The flatten-form stream flowing past the cylinder 7 is separated into two progressively expanding individual streams, slipping over the cylinder surface.

Transversal pulsations with increasing amplitude are generated in each individual stream, said pulsations cause the expanding of the streams, thus decreasing their velocities and distributing the mixture in the chamber cross section.

After the flows separation over the cylinder, the streams join together at a point spaced less than six diameters of the cylinder away from the latter.

The joining of the individual streams takes place after their expanding to such a degree as to be distributed over the entire chamber cross sectional area.

The stream after joining passes throughout the special lattice 9, eliminating the large-scale turbulence of the air-fibre stream and smoothing once more the velocity field in the stream cross-section.

The transformed air-fibre suspension, passes the special lattice 9, in accordance with requirements for the manufacture of homogeneous material, e.g. paper homogeneous in structure, and is delivered through the intermediate unit 11 to the distributing chamber 12 of the aerodynamic forming unit 13.

In the distributing chamber 12 of the forming unit 13 the air-fibre mixture is directed to the travelling wire 14. The velocity of the supplied stream is parallel and about equal to the rate the wire 14 is travelling.

After the air-fibre stream contacts the wire 14, the air is removed by the suction box connected with the intake fan, not shown in drawing, and fibres are deposited and accumulated on the wire 14 in form of a fibrous layer 18 of a uniform thickness. The layer treated with a binder, forms a paper web homogeneous in structure.

What is claimed is:

1. An apparatus for transforming an air-fibre dispersion stream, comprising:

a. a chamber having an elongated cross-section defined by a pair of opposed side walls and a pair of opposed elongated parallel front and back walls connecting said side walls, and having at least one open end;

b. a slot nozzle having an elongated slot opening and disposed within said chamber for injecting a dispersion stream into said chamber, said slot nozzle being positioned with its slot opening generally parallel to the elongated front and back walls of said chamber and facing the open end of said chamber;

c. an elongated body having a length at least equal to a length of the elongated slot opening and disposed with said chamber opposite said slot opening and substantially parallel thereto, said elongated body having a generally cylindrical cross section with a diameter at least 1.2 times a width of the slot opening and opposite the slot opening for dispersing the dispersion stream throughout the chamber in use, wherein said elongated body is spaced from the slot opening about 0.3 to about one diameter of the generally cylindrical cross section thereof; and d. means defining a spatial lattice across a cross section of said chamber downstream from the slot opening at a distance equal to from about two to about six diameters of said elongated body for smoothing the flow of the dispersion dispersed throughout said chamber and flowing out of said at least one open end.

* * * * *